US006131346A

United States Patent [19]

Kordes

[11] Patent Number: 6,131,346

[45] Date of Patent: Oct. 17, 2000

[54] CLAMPING FITTING TO ATTACH GLASS PANES

[75] Inventor: Herbert Kordes, Bad Salzuflen, Germany

[73] Assignee: DORMA GmbH + Co. KG, Ennepetal, Germany

[21] Appl. No.: 09/312,117

[22] Filed: May 14, 1999

Related U.S. Application Data

[63] Continuation-in-part of application No. PCT/EP98/05883, Sep. 16, 1998.

[30] Foreign Application Priority Data

Sep. 17, 1997 [DE] Germany ..... 197 40 878

[51] Int. Cl.[7] ..... E04H 1/00

[52] U.S. Cl. ..... 52/235; 403/388; 411/537; 411/535

[58] Field of Search ..... 52/208, 204.62, 52/204.65, 204.63, 204.68, 202, 203, 585.1, 582.1; 411/535, 536, 546, 383, 384, 396, 397, 366.1, 369; 403/384, 388, 389, 362, 11, 13

[56] References Cited

U.S. PATENT DOCUMENTS

| | | | |
|---|---|---|---|
| 2,213,630 | 9/1940 | Gade | 411/396 |
| 4,453,346 | 6/1984 | Powell | 52/217 |
| 4,662,807 | 5/1987 | Lien | 52/126.5 |
| 5,288,191 | 2/1994 | Ruckert | 411/432 |
| 5,340,258 | 8/1994 | Simon | 411/535 |

FOREIGN PATENT DOCUMENTS

| | | | |
|---|---|---|---|
| 0617190 | 9/1994 | European Pat. Off. . | |
| 3328338 | 2/1985 | Germany . | |
| 9318862 | 5/1995 | Germany . | |
| 4436483 | 4/1996 | Germany . | |
| 4436484 | 4/1996 | Germany . | |
| 29705576 U | 12/1997 | Germany . | |
| 29718406 U | 3/1998 | Germany . | |
| 19652773 | 6/1998 | Germany . | |
| 881607 | 8/1980 | Netherlands . | |
| 2 066 402 | 8/1980 | United Kingdom | 411/535 |
| 9622442 | 7/1996 | WIPO . | |
| 9844234 | 10/1998 | WIPO . | |

OTHER PUBLICATIONS

"Das Fassadensystem für brillante Fassadenganz aus Glas" Pilkington Flachglas.

*Primary Examiner*—Carl D. Friedman
*Assistant Examiner*—Kevin McDermott
*Attorney, Agent, or Firm*—Nils H. Ljungman & Associates

[57] ABSTRACT

A clamping fitting to attach glass panes whereby the clamp screw's screw head and screw shank are conceived as individual components, so that the screw head is vertically displaceable in four degrees of freedom with regard to the screw shank's axis and fixable at a screw shank's holding flange in order to achieve tolerance compensation in the glass pane's plane between the wall mounting and the bore hole in the glass pane. Between a support flange sitting close to a carrier structure and a bore hole in the glass pane, a locating flange sitting close to the glass pane is provided for, which locating flange's distance is variable with regard to the support flange. The distance adjustment is realized by penetrating through the bore hole in the glass pane.

14 Claims, 3 Drawing Sheets

CLAMPING FITTING TO ATTACH GLASS PANES

CONTINUING APPLICATION DATA

This application is a Continuation-In-Part application of International Application No. PCT/EP98/05883, filed on Sep. 16, 1998, which claims priority from Federal Republic of Germany Patent Application No. 197 40 878, filed on Sep. 17, 1997. International Application No. PCT/EP98/05883 was pending as of the filing date of the above-cited application. The United States was an elected state in International Application No. PCT/EP98/05883.

CROSS REFERENCE TO RELATED APPLICATION

This application is related to the co-pending application Ser. No. 09/200,459, filed on Nov. 25, 1998, entitled "Clamping Mounting for Glass Plates, and a Kit to Construct a Clamping Mounting to Mount Glass Plates, and a Method to Utilize a Kit to Construct a Clamping Mounting to Mount Glass Plates", which is hereby incorporated by reference.

BACKGROUND OF THE INVENTION

1. Field of the Invention

The invention relates to a clamping fitting to attach glass panes with a clamp screw, penetrating a bore hole in the glass pane. The fitting is mountable with its screw shank in or at a carrier structure. The clamp screw presents a screw head and a screw shank both conceived as individual components, and the screw head is vertically movable with regard to the screw shank's axis in four degrees of freedom while locatable at a screw shank's holding flange. The screw head furthermore possesses a female threaded cone nut arranged inside the bore hole in the glass pane according to German Patent No. 196 52 773.

2. Background Information

The connection of glass panes with each other to build complete glass curtains or the attachment of glass panes to suitable carrier elements is systematically realized by bore holes in the glass pane. Since the before-mentioned bore holes, as well as the attachment or connection devices engaging or penetrating the bore holes, are subject to certain production tolerances, the normally encountered difficulty includes the problem of realizing the true alignment of the bore hole in the glass pane and the attachment device's or clamping fitting's axis. This problem is solved with the teaching according to the main patent application. In further development of this teaching, it is profitable to not only compensate for production tolerances in the glass pane's plane, but to find moreover an adaptation possibility or adjustability to several distances of the glass pane with regard to the proper attachment point, for example a wall. This is not only valid for mounting a single glass pane having bending moment-free and tension-free characteristics in relation to a wall or the kind, but especially with regard to the true alignment of several adjoining glass panes with regard to each other. It is commonly accepted that, due to construction tolerances, the true-aligned and tension-free mounting of glass panes imperatively necessitates varying distances of the individual bore holes in the glass pane with regard to the attachment point at the wall or the kind. The distance between the bore hole in the glass pane and the attachment point at the wall, or a connecting rod assembly or the kind, must consequently be conceived in a manner that permits variation of location and distance.

European Patent No. 0 617 190 A1 reveals a connection of adjoining glass panes realized by means of a clamping rail bridging the butt joint between the adjoining glass panes at the pane's back front or rear face. Fixing the clamping rail at the glass pane takes place via a cone nut inserted into the glass pane's bore hole, which cone nut presents a female thread directed towards the clamping rail, into which thread a fixing rod, arranged between the cone nut and the clamping rail, is adjustable to vary its location and distance by means of a locknut. Adjustment, in order to achieve a true aligned and tension-free attachment of glass panes, is done in the glass pane's back front or rear face area. Either the back front or rear face must be accessible or other accessories to adjust the position of the adjoining locknuts must be available as they determine the aligned placement of the glass pane with respect to the adjoining glass panes. In practical operation this means that the individual glass panes and the locknuts have to be readjusted several times, representing a huge time investment. Tolerance compensation of adjoining bore holes in the glass pane's plane is performed by a ball-type headed bearing of the connecting rod in the clamping rail. Altogether, with regard to construction as well as to assembly this is an expensive solution. Similar problems result from the mounting for a punctiform, that is, having the form or character of a point, bending moment-free support of multi-layer insulation glass panes according to the German utility model 93 18 862 U1. The mounting bolt employed there determines, by its screw-in depth into the associated mounting case, the glass pane's distance with regard to a wall or the kind, whereby this distance is only modifiable when manipulating the mounting bolt in the glass pane's back front or rear face area. Tolerance compensation is performed in the glass pane's plane between adjoining bore holes in the glass pane by means of bore holes presenting a relatively important diameter in the glass panes, which bore holes are filled in with cast resin during assembly. On the one hand, such important bore holes are not wanted for aesthetic reasons, and, on the other hand, the use of cast resin is correspondingly expensive.

The German Patent No. 44 36 483 A1 discloses an attachment device to attach sheet facings. At a reference level a holding device or carrier structure is solidly linked into which structure's female thread a male threaded bolt is variably screwable to adjust the distance. The bolt's free end on the side opposite to the reference level presents a tapered bolt end at which an internal clamping jaw is supported that is movable in a revolving manner, but axially is stationary. Between the before-mentioned internal clamping jaw and an external clamping jaw that may be clamped with the internal clamping jaw, a sheet facing or the kind is clamped in a way that the sheet facing together with the clamping jaws may pivot in a limited angle around the tapered bolt end. The clamping jaws together with the tapered bolt end form a ball-and-socket joint that allows the sheet facing along with the clamping jaws to be rotated around a swivel point.

The disadvantage of this solution is that the distances are invariable between several attachment devices for one sheet facing, so that mechanical shearing forces or transverse strains are only largely avoided if the ball-and-socket joint swivel point of all attachment devices is located in the sheet facing's thickness center. A clamp screw of that species, whose screw head is fixable at a screw shank's holding flange while vertically movable with regard to the screw shank's axis in four degrees of freedom, that is the horizontal, vertical, and diagonal direction, has not been realized.

German Patent No. 33 28 338 C2 furthermore divulges a device to adjust a first component with regard to a second component, where a distance liner is rotatably fixed at one of both components, which liner's male thread corresponds with the second component's female thread, so that, when rotating the distance liner, the distance between both components is changeable. An apparent motion of both components in four degrees of freedom is not provided for in this connection.

OBJECT OF THE INVENTION

The objective of the invention is to conceive the clamping fitting in further development of the patent's German Patent No. 196 52 773 teaching in that a true aligned, tension-free and bending moment-free assembly is made possible of one or more glass panes, without having to access adjustment or adaptation elements at the back front or rear face of the glass pane, or without necessitating repeated removal and placement or adjustment of the individual glass pane for true alignment purposes.

SUMMARY OF THE INVENTION

The object can be achieved in a screw head that can include a support flange presenting a male thread sitting close to a carrier structure (wall or the kind), a cone nut penetrating the glass pane's bore hole, and a locating flange sitting close to the glass pane arranged between the support flange and the cone nut, which locating flange is screwable by means of a male thread with the cone nut's female thread while fastening the glass pane, whereby the locating flange is adjustable to permit variation of the distance with regard to the support flange by means of a female thread corresponding to the support flange's male thread. The locating flange engaging into the glass pane's bore hole and thus fastening the glass pane from the pane's rear side can be consequently designed to permit variation of the distance with regard to the proper attachment point at a wall or the kind, whereby this distance control may be realized by passing through the glass pane's bore hole. As a result, just a rough adjustment may be needed prior to placing the glass pane on the locating flange fixed to the wall mounting, and, after placing the glass pane on the locating flange, the locating flange can be adjusted in the direction of the glass pane or in opposite direction until it is correctly sitting close to the glass pane. Therefore neither access in the area between the glass pane and the wall nor repeated glass pane placement and removal may be required.

Further characteristics of the present invention are described in the features hereinbelow.

Adjustment of the locating flange with the support flange can be functionally realized by means of a thread between these two components, whereby the support flange presents an oblong hole penetrated by the screw shank to allow the screw head's shifting with regard to the screw shank's axis in four degrees of freedom, that is horizontally, vertically, and diagonally, and to respect bore hole tolerances in the glass pane's plane. For the connecting purpose with the locating flange, the support flange can be provided with a screwed flange corresponding to an appropriate thread in the locating flange.

In further development of the invention, on the side opposite to the support flange, the locating flange itself can be equipped with a screwed flange presenting a hexagon socket or the kind. Instead of a hexagon socket, whatever wrench shapes or the kind may be provided for that are suitable to receive a tool executing a positive screw movement on the locating flange.

A rotation protection, preferably in the form of a locknut setscrew, can be realized between the locating flange and the support flange, which could allow fixing the locating flange with regard to the screw head in whatever wanted adjusted position; that means at the right distance for the exact adjustment. This can be significant to avoid the locating flange's turning with the cone nut when placing the cone nut, which seals the glass pane's front, on the locating flange's screwed flange.

The support flange itself can be fixed by means of a clamp screw at a wall or the kind. For this purpose the clamp screw's screw shank can penetrate the before-described oblong hole and present at its free end a holding flange, between which holding flange and the wall or the kind the support flange is fastened. The aforementioned holding flange therefore can be equipped with a hexagon socket or with another suitable wrench shape with which the clamp screw may be screwed into the wall or the kind. For the before-described clamping fitting's assembly procedure, it is advantageous that the holding flange's hexagon socket diameter be smaller with regard to the diameter of the screwed flange locating flange's hexagon socket.

Generally, the invention proposes the possibility for a true-aligned, bending moment-free and tension-free attachment of individual or several glass panes with regard to a wall or the kind, having a very simple technical layout and manipulation. Further, to simplify the mounting, the distance control of the proper components fastening the glass pane may be accessed by passing through the bore hole in the glass pane.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Hereinafter the invention is explained on the basis of one possible execution example represented by a diagram.

DESCRIPTION OF THE PREFERRED EMBODIMENT

Figure 1:
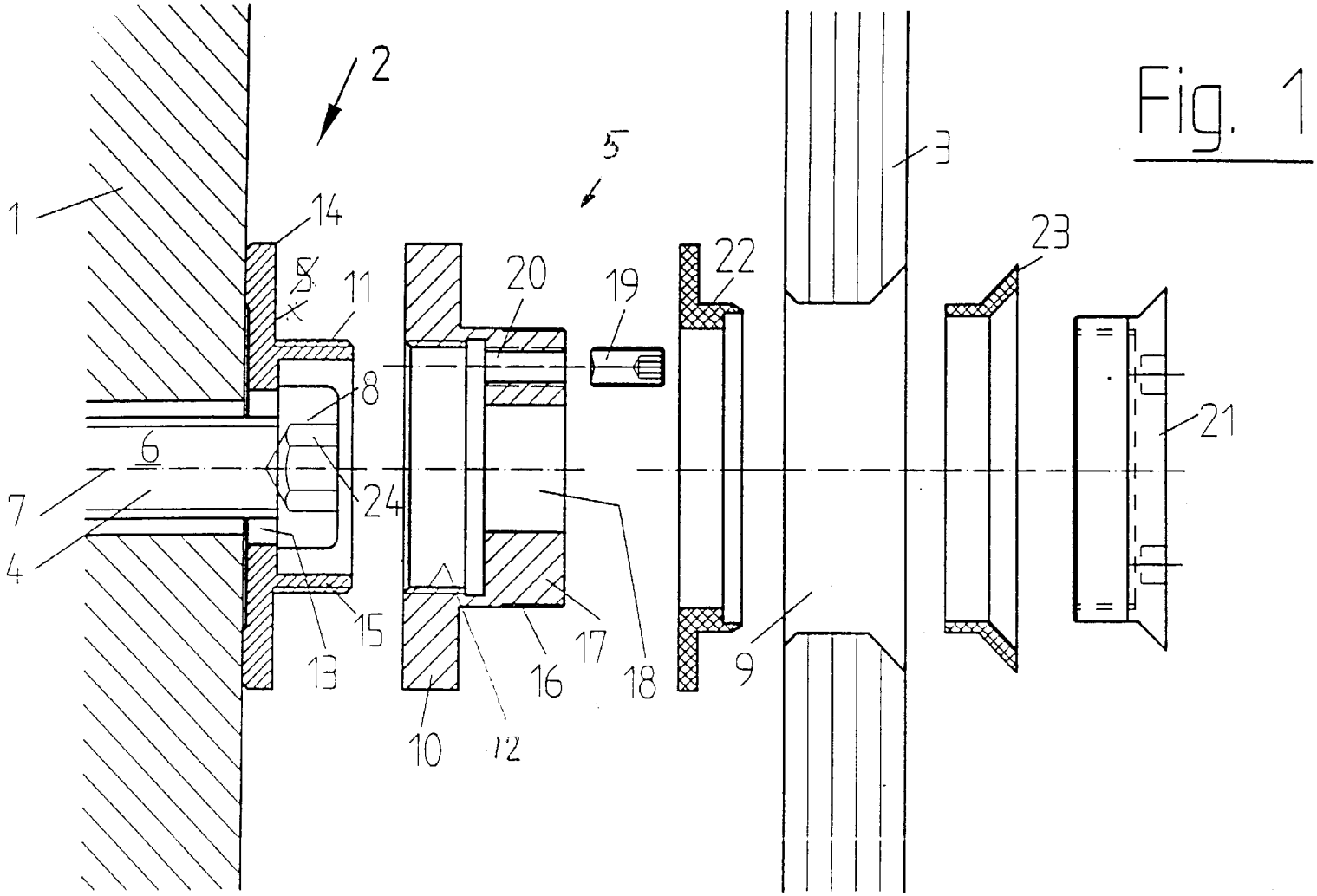
FIG. 1 shows a sectional exploded view of the clamping fitting.

In FIG. 1, a wall mounting with reference 2 is fixed to a wall 1, which wall mounting 2 is composed of a clamp screw 4 with a screw shank 6 presenting a holding flange 8 on its end. The clamp screw's 4 screw head 5 basically comprises a locating flange 10 arranged between a support flange 14 and a cone nut 21. The support flange 14 is fastened between the wall 1 and the holding flange 8. The support flange 14 is provided with an oblong hole 13 so that prior to fastening the support flange 14, the support flange 14 may be adjusted with regard to the screw shank's axis 7 in the four degrees of freedom, or horizontally, vertically, and diagonally, by rotating and simultaneously shifting the support flange 14 with regard to the screw shank's axis 7. Fastening the support flange 14 is realized by screwing the screw shank 6 into the wall 1 by means of a hexagon socket 24 in the holding flange 8.

Moreover FIG. 1 shows that the support flange 14 presents a screwed flange 15 with a male thread 11, onto which a locating flange 10 is screwable with its assigned or corresponding female thread 12. The locating flange 10 also presents a screwed flange 17 with male thread 16, onto which male thread 16 a cone nut 21 is screwable by means of a suitable female thread.

The screwed flange's 17 side is at least provided with one boring 20 to receive a locknut setscrew 19.

A glass protection, that may be slipped on the locating flange's 10 screwed flange 17, is referenced with 22 and 23 and refers to a clamping ring 23 slipping on the cone nut 21. After completed assembly, the glass protection 22 and the clamping ring 23 cover the bore hole 9 in the glass pane 3.

Figure 2:
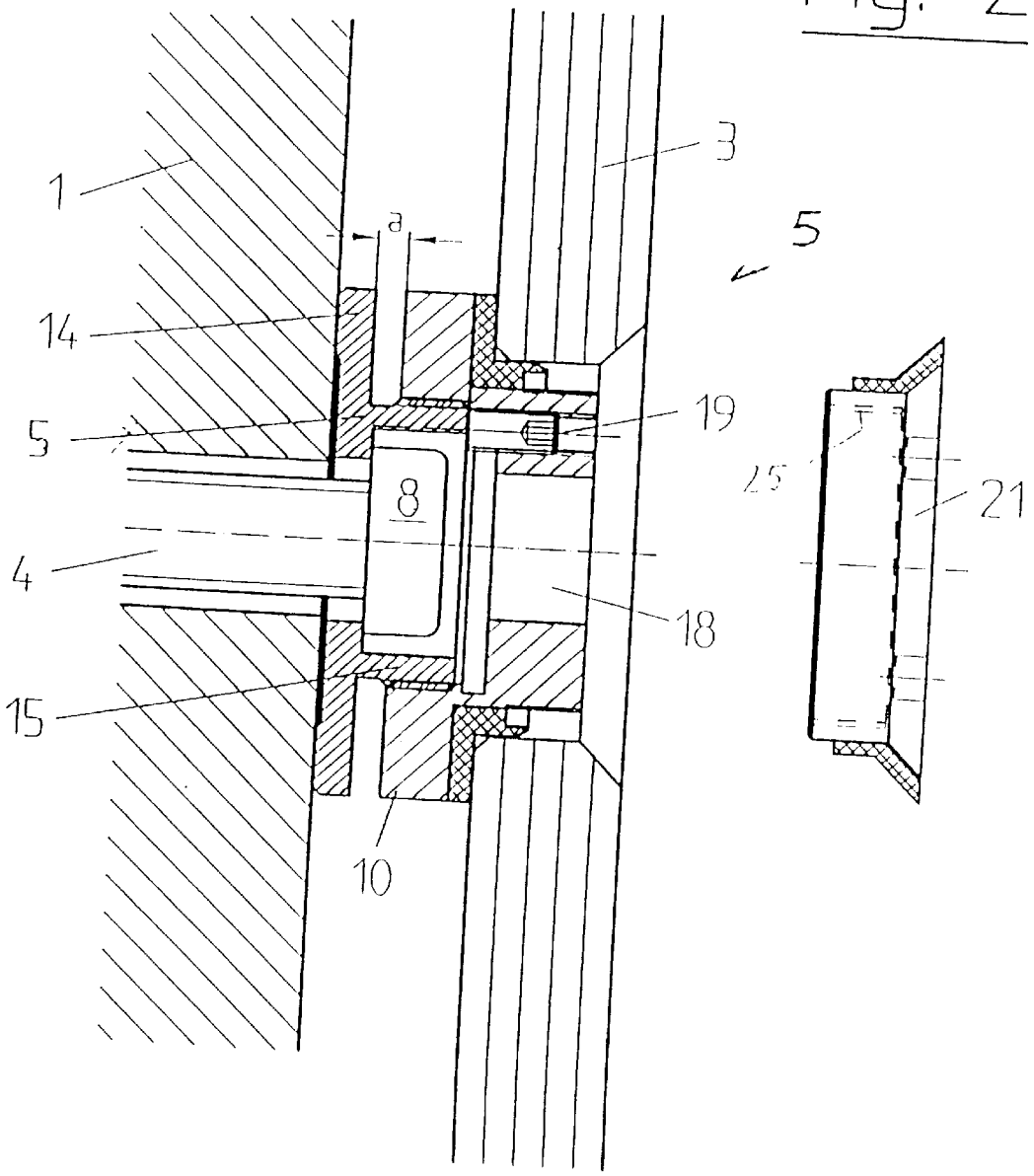
FIG. 2 shows the clamping fitting according to FIG. 1 partially assembled.

FIG. 2 displays that while adjusting the glass pane 3, the locating flange 10 is only partially screwed onto the support flange's 14 screwed flange 15, resulting in the distance "a" between the support flange 14 and the locating flange 10. According to the representation in FIG. 2, after finishing the glass pane's 3 adjustment, a locknut setscrew 19 is firmly screwed against the screwed flange 15, so that finally the cone nut 21 may be screwed on with inserted clamping ring 23.

Figure 4:
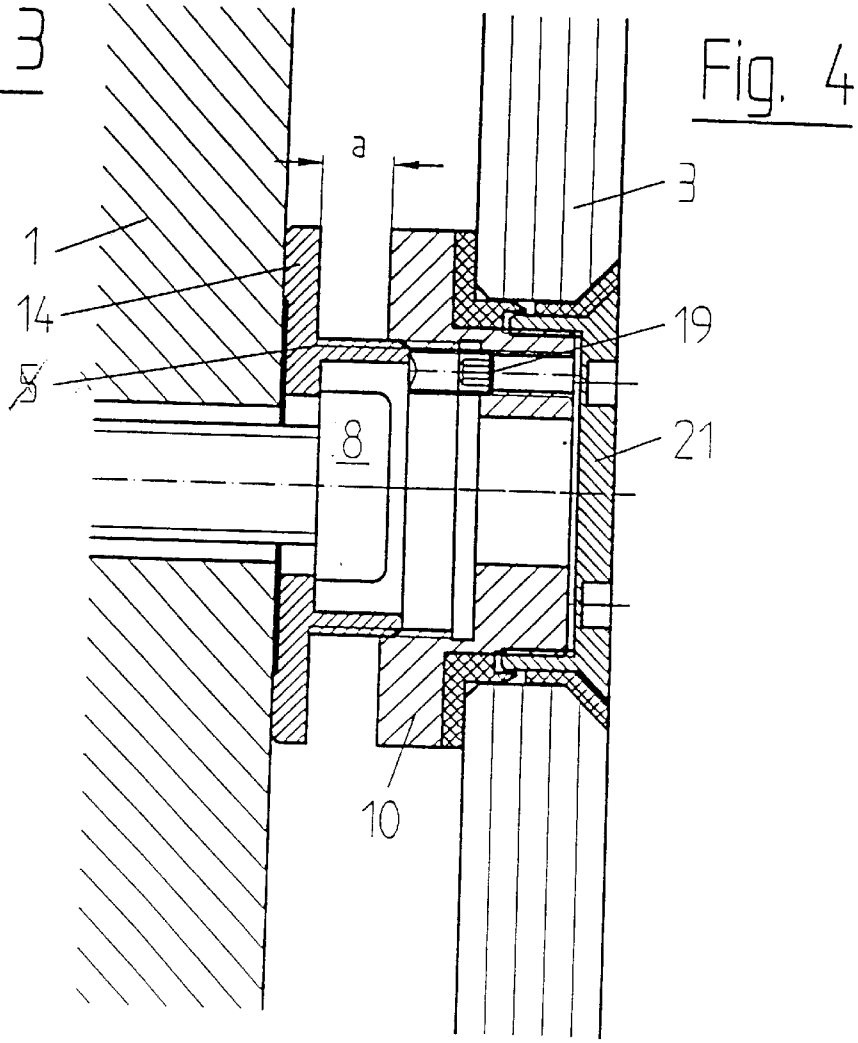
FIG. 4 shows the clamping fitting according to FIG. 1 completely assembled with a distance between the wall and the glass pane.
Figure 3:
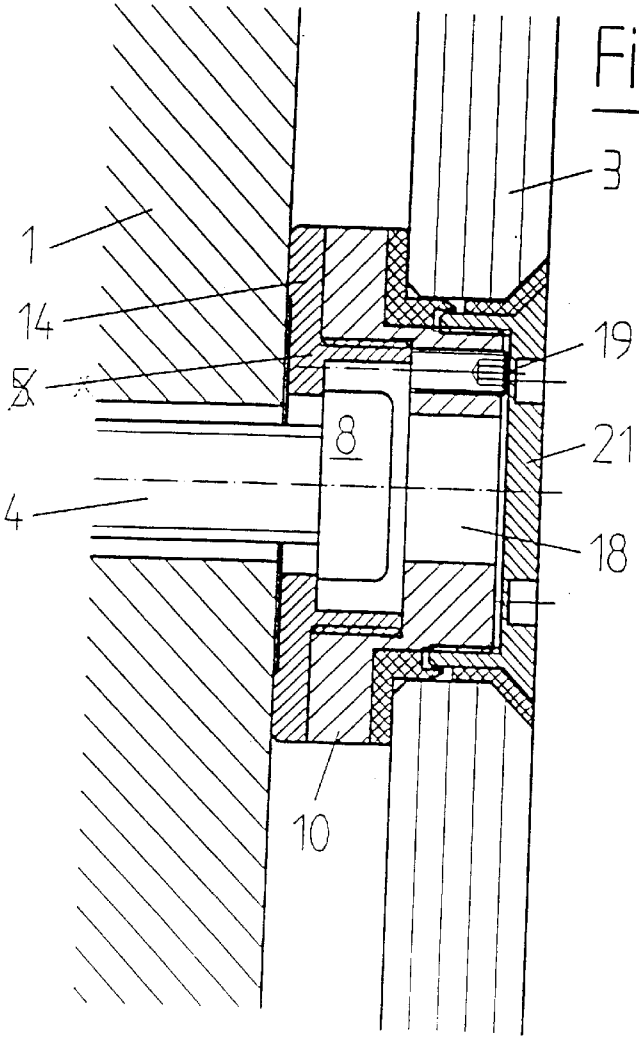
FIG. 3 shows the clamping fitting according to FIG. 1 completely assembled with a distance between the wall and the glass pane.

The cone nut 21 is mounted according to FIGS. 3 and 4. While adjusting according to FIG. 3, the locating flange 10 is screwed as far as possible against the support flange 14, whereas in the other extreme position, according to FIG. 4 between those two components, the distance with reference "a'" is established.

The clamping fitting's assembly is explained hereinafter on the basis of FIG. 1:

First, the wall mounting 2 is realized by screwing the clamp screw 4 by means of the hexagon socket 24 only so far into the wall so that the support flange 14 may be dislocated with regard to the holding flange 8. Then, the locating flange 10 is screwed onto the support flange's 14 male thread 11 according to a rough estimation of the true aligned position with respect to the wall or adjoining glass plates.

After partially screwing the locknut setscrew 19 and slipping on the glass protection 22, the glass pane 3 is put in place. By adjusting the support flange 14 with regard to the clamp screw's 4 screw shank 6, bore hole tolerances are compensated in the glass pane's 3 plane. After finishing compensation, the support flange 14 is solidly fastened to the wall 1 via the clamp screw 4. After adjusting different distances of the individual bore holes between the wall 1 and the glass pane 3 by turning the locating flange 10 with regard to the support flange 14, the locknut setscrew 19 is positioned to avoid the locating flange's 10 turning with the cone nut when placing the cone nut 21. After having placed the clamping ring 23 on the cone nut 21 according to FIGS. 3 and 4, the latter may be screwed with the male threaded 16 screwed flange 17 of the locating flange 10.

It is obvious that the operation of the clamp screw 4 via the hexagon socket 24, as well as the operation of the locating flange 10 via the hexagon socket 18, may be accessed through the bore hole in the glass pane 3. This means that adjusting the whole clamping fitting is realized in the plane of the glass pane 3 as well as vertically with regard to it, which means that changing the distance with regard to a wall or the kind is accomplished all through the bore hole 9 in the glass pane 3.

One feature of the invention resides broadly in the clamping fitting to attach glass panes with a clamp screw penetrating a bore hole in the glass pane, mountable with its screw shank in or at a carrier structure, which clamp screw presents a screw head and a screw shank realized as individual components, and whereby the screw head is fixable at a screw shank's support flange while displaceable vertically with regard to the screw shank's axis in four degrees of freedom, whereby the screw head moreover presents a female threaded cone nut arranged inside the bore hole in the glass pane according to patent DE 196 52 773, characterized in that the screw head 5 comprises a male threaded 16 support flange 14 sitting close to the carrier structure (wall 1 or the kind), of the cone nut 21 penetrating the glass pane's 3 bore hole 9 and of a locating flange 10 arranged between the support flange 14 and the cone nut 21 sitting close to the glass pane 3, which locating flange is screwable via a male thread 16 with the female threaded 25 cone nut 21 while fastening the glass pane 3, and in that the locating flange 10 is distance variably adjustable with regard to the support flange 14 via a female thread 12 corresponding to the male threaded 11 support flange 14

Another feature of the invention resides broadly in the clamping fitting characterized in that the support flange 14 presents an oblong hole 13 penetrated by the screw shank 6 and a male threaded 11 screwed flange 15.

Yet another feature of the invention resides broadly in the clamping fitting characterized in that the locating flange 10 presents a male threaded 16 screwed flange 17 on its side opposite to the support flange 14.

Still another feature of the invention resides broadly in the clamping fitting characterized in that the locating flange's 10 screwed flange 17 presents a hexagon socket 18 or the kind.

A further feature of the invention resides broadly in the clamping fitting characterized in that the screw shank's 6 holding flange 8 displays a hexagon socket 24 or the kind.

Another feature of the invention resides broadly in the clamping fitting characterized in that the holding flange's 8 hexagon socket 24 has a smaller diameter compared to the hexagon socket 18 of the locating flange's 10 screwed flange 17.

Some examples of glass mountings or glass mounting devices which may possibly be utilized or adapted for use in the context of the present invention may be found in the following U.S. Pat. Nos. and U.S. Patent Applications: No. 5,323,577, issued on Jun. 28, 1994 to Whitmyer; No. 5,283,978, issued on Feb. 8, 1994 to Horgan, Jr.; No. 5,212,922, issued on May 25, 1993 to Werner; No. 4,841,697, issued on Jun. 27, 1989 to Hogg, et al.; No. 4,097,320, issued on Jun. 27, 1978 to Brauer et al.; No. 4,054,268, issued on Oct. 18, 1977 to Sher; No. 4,016,690, issued on Apr. 12, 1997 to Richardson; and application Ser. No. 09/200,459, filed on Nov. 25, 1998 by applicant Blbbaum.

Some examples of glass facades and methods of securing glass panels of a facade which may possibly be utilized or adapted for use in the context of the present invention may be found in the following U.S. Pat. Nos. 5,791,105, issued on Aug. 11, 1998 to Gangi; No. 5,524,404, issued on Jun. 11, 1996 to Lahaye; No. 5,493,831, issued on Feb. 27, 1996 to Jansson; No. 5,373,672, issued on Dec. 20, 1994 to Schulz; No. 5,301,484, issued on Apr. 12, 1994 to Jansson; No. 5,184,440, issued on Feb. 9, 1993 to Felix, et al.; No. 5,069,014, issued on Dec. 3, 1991 to Kubbutat; No. 4,837,996, issued on Jun. 13, 1989 to Eckelt; and No. 4,793,112, issued on Dec. 27, 1988 to Sufke.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 40 878, filed on Sep. 17, 1997, having inventor Herbert Kordes, and DE-OS 197 40 878 and DE-PS 197 40 878 and International Application No. PCT/EP98/05883, filed on Sep. 16, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A clamping fitting to attach glass panes, said clamping fitting comprising:

a clamp screw;

said clamp screw being configured to penetrate a bore hole in a glass pane;

said clamp screw comprising a screw shank;

said clamp screw being configured to be mounted with its screw shank adjacent a carrier structure;

said clamp screw comprising a screw head;

said screw shank comprising a holding flange;

said screw shank having a longitudinal axis;

said screw head is configured to be fixed at said holding flange of said screw shank;

said holding flange of said screw shank being configured to permit said screw head to be displaced vertically with regard to the longitudinal axis of the screw shank in four degrees of freedom; and said screw head comprising:

a female-threaded cone nut;

said female-threaded cone nut being configured to be disposed inside a bore hole in a glass pane;

a male-threaded support flange;

said male-threaded support flange being configured to be disposed adjacent a carrier structure;

a locating flange;

said locating flange being configured to be disposed between said male-threaded support flange and said female-threaded cone nut;

said locating flange being configured to be disposed adjacent to a glass pane;

said locating flange comprising a male thread;

said male thread of said locating flange being configured to engage with said female thread of said female-threaded cone nut to permit fastening of a glass pane;

said locating flange further comprising a female thread; and said female thread of said locating flange being configured to engage with said male thread of said male-threaded support flange to permit axial adjustment of said locating flange.

2. Clamping fitting according to claim 1, wherein:

said support flange comprises an oblong hole;

said screw shank is configured to penetrate said oblong hole;

said support flange comprises a screwed flange portion; and said male thread of said support flange is disposed on said screwed flange portion.

3. Clamping fitting according to claim 1, wherein:

said locating flange comprises a male-threaded screwed flange portion;

said male-threaded screwed flange portion is disposed on the side of said locating flange facing away from said support flange; and said male thread of said locating flange is disposed on said male-threaded screwed flange portion of said locating flange.

4. Clamping fitting according to claim 2, wherein:

said locating flange comprises a screwed flange portion;

said screwed flange portion of said locating flange is disposed on the side of said locating flange facing away from said support flange; and said male thread of said locating flange is disposed on said screwed flange portion of said locating flange.

5. Clamping fitting according to claim 3, wherein said screwed flange portion of said locating flange comprises a hexagon socket.

6. Clamping fitting according to claim 4, wherein said screwed flange portion of said locating flange comprises a hexagon socket.

7. Clamping fitting according to claim 1, wherein said holding flange of said screw shank comprises a hexagon socket.

8. Clamping fitting according to claim 2, wherein said holding flange of said screw shank comprises hexagon socket.

9. Clamping fitting according to claim 3, wherein said holding flange of said screw shank comprises a hexagon socket.

10. Clamping fitting according to claim 5, wherein said holding flange of said screw shank comprises a hexagon socket.

11. Clamping fitting according to claim 7, wherein said hexagon socket of said holding flange has a smaller diameter than the hexagon socket of said screwed flange portion of said locating flange.

12. Clamping fitting according to claim 8, wherein said hexagon socket of said holding flange has a smaller diameter than the hexagon socket of said screwed flange portion of said locating flange.

13. Clamping fitting according to claim 9, wherein said hexagon socket of said holding flange has a smaller diameter than the hexagon socket of said screwed flange portion of said locating flange.

14. Clamping fitting according to claim 10, wherein said hexagon socket of said holding flange has a smaller diameter than the hexagon socket of said screwed flange portion of said locating flange.

* * * * *

UNITED STATES PATENT AND TRADEMARK OFFICE

CERTIFICATE OF CORRECTION

PATENT NO. : 6,131,346

DATED : October 17, 2000

INVENTOR(S) : Herbert KORDES

It is certified that error appears in the above-identified patent and that said Letters Patent is hereby corrected as shown below:

In column 6, line 61, after 'applicant', delete "Blbbaum." and insert --Blöbaum.--.

In column 8, line 63, Claim 8, after 'comprises' insert --a--.

Signed and Sealed this

Eighth Day of May, 2001

*Attest:*

Nicholas P. Godici

NICHOLAS P. GODICI

*Attesting Officer*

*Acting Director of the United States Patent and Trademark Office*